United States Patent [19]

Campbell

[11] Patent Number: 4,875,864

[45] Date of Patent: Oct. 24, 1989

[54] GROUND CLAMP FOR COAXIAL CABLE JUNCTION BLOCK

[76] Inventor: Marvin J. Campbell, 4904 W. Vliet St., Milwaukee, Wis. 53208

[21] Appl. No.: 322,613

[22] Filed: Mar. 13, 1989

[51] Int. Cl.[4] ..... H01R 4/66; H01R 17/04

[52] U.S. Cl. ..... 439/100; 439/578; 439/800

[58] Field of Search ..... 439/100, 799, 800, 675, 439/641, 642, 638, 648, 578, 581

[56] References Cited

U.S. PATENT DOCUMENTS 3,781,771 12/1973 Blake ..... 439/799

FOREIGN PATENT DOCUMENTS 541686 7/1922 France ..... 439/675

*Primary Examiner*—Gary F. Paumen

*Attorney, Agent, or Firm*—Andrus, Sceales, Starke & Sawall

[57] ABSTRACT

An assembly for attaching a coaxial cable junction block to a tubular grounding member includes a thin metal strap adjustably attached to the junction block to secure it to a grounding member, such as an electrical service conduit. The easily attachable assembly simultaneously provides for the interconnection between two coaxial cable sections, convenient mounting of the assembly eliminating the need to provide mounting holes in a building side wall or the like, and direct grounding of the cable sections without the need for a separate ground wire connection. In lieu of a single mounting band, the assembly may utilize a pair of U-shaped clamping members. In either embodiment, inwardly projecting holding teeth on the band or clamping members facilitates a secure mounting and ensures conductive contact through any insulating coating on the tubular grounding member.

9 Claims, 2 Drawing Sheets

FIG. 4
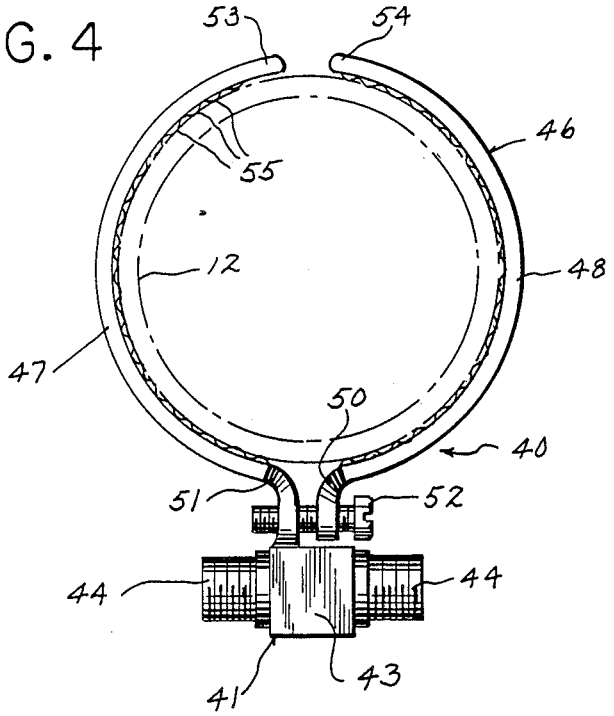
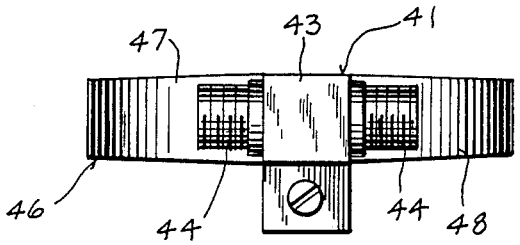
FIG. 5
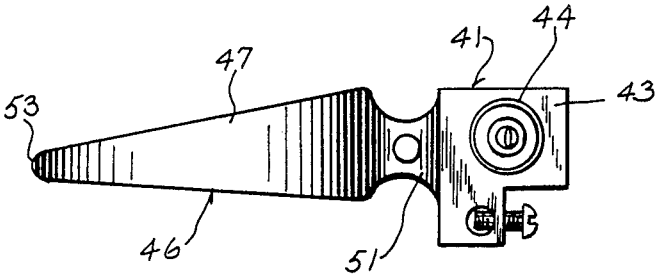
FIG. 6

GROUND CLAMP FOR COAXIAL CABLE JUNCTION BLOCK

BACKGROUND OF THE INVENTION

The present invention relates to an assembly for electrically grounding a coaxial cable and, more particularly, to a grounding clamp or strap for attaching the junction block to a tubular grounding member.

In providing cable television service to a residential or other building, or in providing a connection to the interior of a building from an outside antenna system such as a satellite dish, the signals may be carried on a conventional coaxial cable. In a typical coaxial cable installation, the cable is run to the approximate point of entry into the building where it is cut and provided with a conventional coaxial connector including a threaded outer end sleeve. Similarly, a coaxial cable section is extended through the building wall and provided on its outside end with an identical standard end fitting. Connection between the terminated ends of the main incoming cable and the cable section from within the building is made by utilizing a coaxial cable junction block. The junction block includes a pair of axially aligned and oppositely extending threaded connector studs to which the respective threaded sleeves of the cable end fittings are attached. The connector studs include a common coaxial interior connector which is electrically insulated from the studs and the mounting block and which provides interconnection between the terminated interior conductor in the two coaxial cable sections.

By utilizing a coaxial cable junction block, installers can install the section through the wall of the building completely independently of and at a different time than the time at which connection from the main coaxial cable to the building is made. However, the junction block must be separately attached to the outer wall or other portion of the building and, additionally, a separate grounding connection must be made from the block to a suitable ground, such as an electrical conduit, pipe, or the like. Thus, the installer must drill holes or otherwise provide some means for attachment of the junction block to the building and must additionally repair and attach a separate ground lead between the junction block and the grounded conduit or the like. Providing an appropriate attachment of the junction block to the building may be difficult or objectionable to the owner. Providing a separate grounding connection is also time consuming and requires the use of additional materials.

Grounding clamps of the type using a flexible strap which is wrapped around a tubular grounded conduit and clamped thereto are well known in the art. U.S. Pat. No. 4,623,204 discloses a ground clamp including a thin flexible strap adapted to surround a conventional metal conduit and a bolt subassembly which provides both adjustable connection of the strap ends and a connection for attachment or a ground wire. U.S. Pat. No. 4,626,051 shows a similar grounding strap including a bolt assembly which provides both adjustable interconnection and clamping of the ends of the conduit-encircling strap and connection for the end of a terminated ground wire. U.S. Pat. No. 4,664,469 shows another grounding strap in which one of a series of holes in one end of the strap is attached to an integral protruding hook on the other end of the strap and the strap is tensioned about the grounded conduit by a radially disposed bolt assembly which acts to place the strap in tension and tighten it about the conduit. Each of the foregoing patents provides means for the separate attachment of a ground wire, as does the conventional coaxial cable junction box of the prior art described above.

It would be most convenient and desirable to eliminate the need to attach a coaxial cable junction block directly to the structure near the point of cable entry and to eliminate the separate ground wire connection which must ordinarily be made to the junction block.

SUMMARY OF THE INVENTION

In accordance with the present invention, a coaxial cable junction block is provided with an adjustable mounting strap for direct attachment to a ground conduit which provides a direct ground connection for the block and attached outer conductors of the interconnected coaxial cable sections, and also eliminates the problems of attaching the junction block directly to the outside wall of the building. Because coaxial cable installations generally enter the building in the area where other utility electrical connections (such as electric power and telephone) are made, a grounded tubular conduit can be used for attachment of the clamping strap of the present invention.

In the assembly of the present invention, an adjustable strap means i adapted to substantially encircle the tubular conduit or other grounded member for clamping the assembly thereto. The strap means includes internally projecting holding teeth which engage the conduit as the strap means is clamped thereon. Strap includes end portions which are adapted to be adjustably moved relative to one another to affect the clamping action. One of the end portions of the strap means is fixed to the outer surface of a coaxial cable junction block and the other end portion of the strap means is adapted to receive threaded fastening means for adjustably connecting it to the junction block.

The other free end portion of the strap means preferably includes a series of longitudinally disposed adjustment holes adapted to selectively receive a mounting bolt which is threaded into a suitably tapped bore in the junction block to secure the strap thereto and draw it tightly around the tubular conduit. In the preferred embodiment, the flexible strap means an attached junction block completely encircle the conduit when attached thereto. In an alternate embodiment, the strap means comprises a pair of relatively rigid U-shaped clamping members, one of which is integrally attached at one end to the junction block and the other of which includes a hole for receipt of the mounting bolt. The opposite free ends of the U-shaped clamping members move relative to one another as clamping is effected. The clamping bolt and cooperating tapped hole in the junction block are otherwise identical to the preferred embodiment.

BRIEF DESCRIPTION OF THE DRAWING

FIG. 4 is a top plan view, similar to FIG. 1, showing an alternate embodiment of the clamping assembly.

FIG. 5 is a front elevation of the embodiment of the clamping assembly shown in FIG. 4.

FIG. 6 is a side elevation of the clamping member shown in FIGS. 4 and 5.

DETAILED DESCRIPTION OF THE PREFERRED EMBODIMENT

Figure 1:
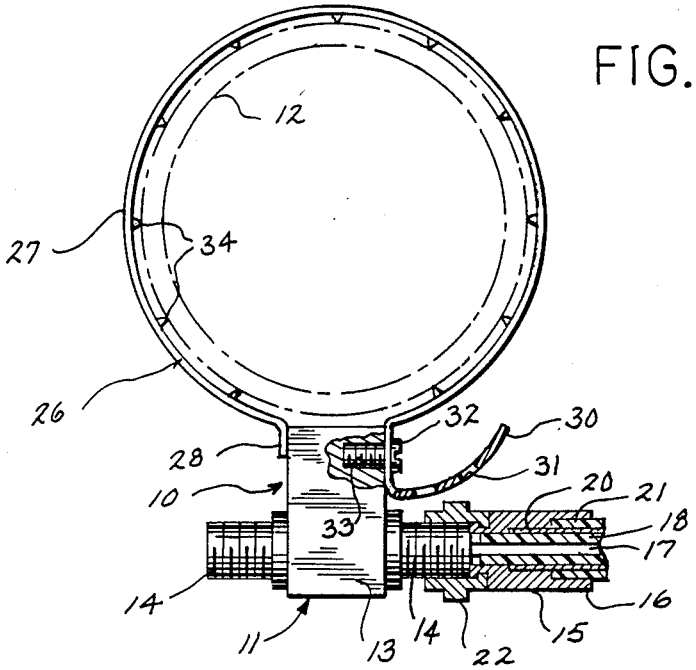
FIG. 1 is a top plan view of the mounting assembly of the present invention in its operative attached position around a tubular grounding member.
Figure 2:
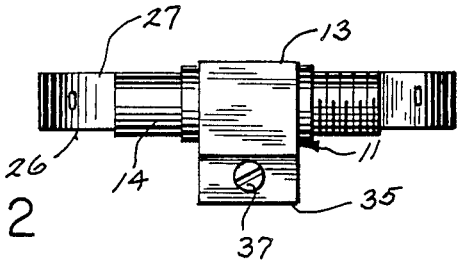
FIG. 2 is a front elevation of the clamping assembly shown in FIG. 1.
Figure 3:
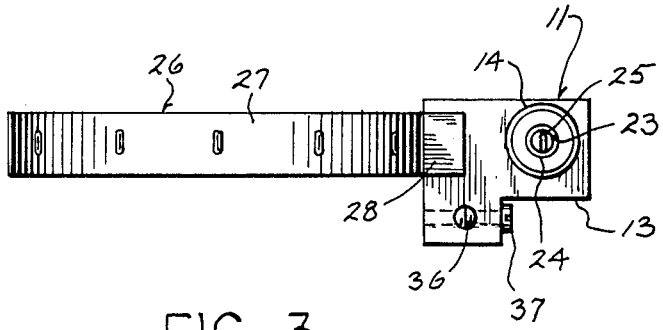
FIG. 3 is a side elevation of the clamping assembly shown in FIGS. 1 and 2.

Referring first of FIGS. 1–3, there is shown the preferred embodiment of a mounting assembly 10 for attaching and grounding a coaxial cable junction block 11 to a tubular grounding member 12. The junction block 11 includes a generally cube-shaped body 13 having a pair of axially aligned, oppositely extending threaded connector studs 14 attached thereto. The connector studs 14 are adapted to receive a conventional coaxial cable end fitting 15, thus providing a junction for the terminated ends of two sections of coaxial cable 16 (only one of which is shown in FIG. 1).

A conventional coaxial cable 16 includes a solid inner conductor wire 17, an inner insulating sleeve 18 surrounding the conductor, an outer conductor 20 which may be braided metal for flexibility, and an insulating outer covering 21. The end fitting 15 is conductively attached to the outer conductor 20 and includes an internally threaded sleeve 22 by which the end fitting is attached to a connector stud 14 on the junction block 11.

Each connector stud 14 has an axial through bore 23 which extends through the body 13 of the junction block and into alignment with the through bore of the axially aligned connector stud on the opposite side. The through bore 23 is lined with an insulator sleeve 24 which encapsulates a conductive wire connector 25. When the coaxial cable 16 is provided with an end fitting 15 the inner conductor 17 is trimmed in a well known manner such that it extends beyond the axial outer end of the fitting. When the fitting and attached cable are mounted to a connector stud 14 the extended inner conductor 17 is inserted into the through bore 23 where it makes connection with the internal wire connector 25. When the other cable section is attached by its end fitting 15 to the other connector stud 14, its extended inner conductor 17 will also engage the opposite end of the wire connector 25, thus providing a conductive connection between cable sections which is insulated from the junction block and connector studs. This is the active signal carrying conductor. The outer conductor 20 of the cable 16 is typically grounded to protect the system and connected equipment against voltage surges. Because the end fitting 15 is conductively connected to the outer conductor 20, prior art arrangements utilized a separate ground wire connection between the junction block 18 and some sort of grounding member, such as an electrical service conduit.

The modified junction block 11 of the present invention includes an adjustable strap 26 by which the junction block may be attached directly to a tubular grounding member 12, such as a conventional electric service conduit. The adjustable strap 26 comprises a thin metal band 27 which is fixed at one end 28 to one side wall of the junction block 11 and adapted to be wrapped around the conduit and adjustably attached by its opposite free end 30 to the opposite side wall of the junction block. The free end 30 of the adjustment strap 26 is provided with a series of longitudinally disposed adjustment holes 31 to accommodate attachment to tubular grounding members 12 of varying diameters. The free end 30 is attached to the side wall of the junction block 11 with a suitable threaded fastener, such as a mounting bolt 32 extending through an adjustment hole 31 and into a suitably tapped bore 33 in the side wall of the junction block 11.

A portion of the interior surface of the metal band 27 is preferably provided with a series of holding teeth 34 directed radially inwardly when the strap is attached to the conduit and which teeth bite into the surface thereof as the strap is tightened by attachment of the mounting bolt 32. The holding teeth 34 provide two functions, namely, to help secure the strap tightly in place and to bite through any insulating surface (such as paint) on the tubular conduit 12 which might otherwise prevent a conductive grounded connection between the strap and the conduit. Once the free end 30 of the band 27 has been attached to the junction block, the excess length may be bent back.

The attachment and grounding assembly described hereinabove thus eliminates both the need to mount the junction block directly to the outside wall of the building or other structure, requiring the drilling of mounting holes or the like, and simultaneously provides direct grounding of the coaxial cable 16 without the need to employ a separate ground wire and related attachments.

Nevertheless, the junction block 11 may be provided with an auxiliary ground wire mount 35 of the type used on prior art junction blocks. If utilized, the auxiliary ground wire mount may be provided on an offset integral extension on the lower part of the body 13 of the junction block. The auxiliary mount comprises a ground wire-receiving bore 36 extending laterally through the body of the ground wire mount 35. A set screw 37 is disposed in a tapped hole transverse to the bore 36 for securing one end of an auxiliary ground wire therein. The auxiliary ground wire mount 35 is not required for the grounding attachment of the coaxial cable, but provides a convenient attachment for a ground wire from an unrelated accessory which is desired to be grounded.

FIGS. 4–6 show an alternate mounting assembly 40 which includes a junction block 41 that is identical to the junction block 11 of the preferred embodiment, except for the means for attaching it to the tubular grounding member or conduit 12. Thus, the body 43 of the junction block 41 includes a pair of oppositely extending integral connector studs 44 for receipt of the end fittings 15 of conventional coaxial cable sections 16 (as shown in FIG. 1). In the embodiment of FIGS. 4–6 the adjustment strap 46 comprises a pair of relatively rigid U-shaped clamping members 47 and 48. Clamping member 47 is formed integrally with or permanently attached to the body 43 of the junction block 41 in a manner to provide generally semicircumferential engagement of the conduit 12. The other clamping member 48 is similarly shaped but includes a first free end 50 adapted to be attached to the fixed end 51 of the other clamping member 47. As shown, attachment between the ends 50 and 51 of the clamping members may be effected with a mounting screw 52 or the like which may be utilized to draw the ends 50 and 51 together to effect clamping of the members 47 and 48 about the tubular grounding member 12. The free end 53 of the fixed clamping member 47 and the second free end 54 of the other clamping member 48 are preferably tapered to provide relatively narrower opposing ends and are also somewhat foreshortened to provide some flexibility in the diameter of conduits 12 to which they may be attached without interference. However, by slightly adjusting the free clamping member 48 about the axis of the mounting screw 52, such that the members 47 and 48 are not coplanar, the ends 53 and 54 may be allowed to overlap slightly for clamping about smaller diameter conduits. In addition, the clamping members 47 and 48 may be made of a flexible metal allowing them to be bent somewhat to better engage a wider range of conduit diameters. As with the mounting assembly of the preferred embodiment, the clamping members 47 and 48 of the mounting assembly 40 may be provided with a series of radially inwardly projecting holding teeth 55 to enhance the grip of the clamping members on the conduit 12 and to penetrate any insulting coating thereon.

Various modes of carrying out the present invention are contemplated as being within the scope of the following claims particularly pointing out and distinctly claiming the subject matter which is regarded as the invention.

What is claimed:

1. An assembly for mounting, interconnecting, and grounding a pair of terminated coaxial cable sections to a tubular grounding member comprising:

a coaxial cable junction block including a pair of connectors adapted to receive and electromechanically interconnect the terminated ends of the coaxial cable sections;

adjustable strap means attached to the junction block and adapted to substantially encircle the grounding member for clamping the block thereto;

said adjustable strap means including one end portion fixedly attached to the junction block and another end portion adjustable with respect to the fixed end and the junction block; and, threaded fastening means for adjustably connecting the ends of the strap means to effect the clamping of the assembly to the tubular grounding member.

2. The assembly as set forth in claim 1 wherein said adjustable strap means comprises a thin metal band.

3. The assembly as set forth in claim 2 comprising:

a plurality of adjustment holes spaced along the free end of the metal band;

a threaded bore in the junction block opposite the attachment of said one end portion of strap means; and, a mounting bolt adapted to be selectively inserted through one of the adjustment holes and into the threaded bore.

4. The assembly as set forth in claim 1 wherein the metal band is provided with a series of holding teeth projecting radially inwardly and adapted to engage the tubular grounding member.

5. The assembly as set forth in claim 1 including an auxiliary ground wire mount forming an integral part of the junction block.

6. The assembly as set forth in claim 1 wherein said adjustable strap means comprises a pair of U-shaped clamping members, one of said members integrally attached at one end to the junction block and the other of said members having one free end adapted to receive said threaded fastening means.

7. The assembly as set forth in claim 6 wherein the inner surfaces of said U-shaped clamping members include a series of inwardly projecting holding teeth.

8. The assembly as set forth in claim 7 wherein said threaded fastening means comprises a bolt extending through said one free end of the other clamping member and through a tapped hole in the fixed end of said one clamping member adjacent its attachment to the junction block.

9. The assembly as set forth in claim 6 wherein the free opposite ends of said clamping members include narrow tapered end portions.

* * * * *